United States Patent [19]

Tsunekawa et al.

[11] Patent Number: 4,483,142

[45] Date of Patent: Nov. 20, 1984

[54] OUTPUT CONTROL SYSTEM FOR STIRLING ENGINES

[75] Inventors: Masura Tsunekawa, Okazaki; Yoshihiro Naito, Nagoya, both of Japan

[73] Assignee: Aisin Seiki Kabushiki Kaisha, Asahi, Japan

[21] Appl. No.: 580,249

[22] Filed: Feb. 15, 1984

[30] Foreign Application Priority Data

Mar. 10, 1983 [JP] Japan ..... 58-38330

[51] Int. Cl.[3] ..... F02G 1/06

[52] U.S. Cl. ..... 60/521; 60/517

[58] Field of Search ..... 60/517, 521, 522, 525; 62/6

[56] References Cited

U.S. PATENT DOCUMENTS 3,397,533 8/1968 Steiner et al. ..... 60/521

3,550,371 12/1970 Jaspers ..... 60/521

3,827,241 8/1974 Almstrom et al. ..... 60/521

*Primary Examiner*—Stephen F. Husar

*Attorney, Agent, or Firm*—Burns, Doane, Swecker and Mathis

[57] ABSTRACT

An output control system for a Stirling engine includes a pressure reducing valve disposed in a highest-cycle-pressure line and connected between at least one working space and a compressor and a booster valve disposed in a lowest-cycle-pressure line and connected between the working space and the compressor. The pressure reducing valve and the booster valve are selectively actuatable by an accelerator lever attached to a feedback piston cylinder connected to the lowest-cycle-pressure line. The output control system also includes a two-way unidirectional solenoid-operated valve disposed in the highest-cycle-pressure line upstream of the pressure reducing valve and a three-way bidirectional solenoid-operated valve disposed in the lowest-cycle-pressure line downstream of the booster valve. The solenoid-operated valves are controlled by a control unit to close the highest-cycle-pressure line and connect the lowest-cycle-pressure line through a regulator valve to a source of high pressure gas when the engine is at rest.

3 Claims, 3 Drawing Figures

OUTPUT CONTROL SYSTEM FOR STIRLING ENGINES

BACKGROUND OF THE INVENTION

The present invention relates to a system for controlling the output of a Stirling engine.

The output of an external combustion engine known as a Stirling engine is determined by the pressure of a working gas in a working space. When it is desired to increase the engine output, for example, the pressure of the working gas in the working space is raised.

FIG. 1 of the accompanying drawings shows a typical example of an output control system for a Stirling engine as disclosed in Japanese Laid-Open Patent Publication No. 46-23534. The Stirling engine has working spaces 1 coupled to a compressor 3 through check valves 2 and a highest-cycle-pressure line 4 having a pressure reducing valve 5. The working spaces 1 are also coupled to the compressor 3 through check valves 6 and a lowest-cycle-pressure line 7 having a booster valve 8. A high-pressure tank 9 is connected to the booster valve 8 parallel to the compressor 3.

The booster valve 8 has its downstream end connected to a feedback piston cylinder 10 having a piston coupled through a piston rod to an accelerator lever 11 at an end thereof serving as a fulcrum 14. The accelerator lever 11 is positioned between valve rods 12, 13 of the valves 8, 5 for engagement therewith. The piston of the feedback piston cylinder 10 is movable dependent on the pressure in the lowest-cycle-pressure line 7 for displacing the position of the fulcrum 14 of the accelerator lever 11.

In operation, when the output of the Stirling engine is to be increased, the accelerator lever 11 is pushed to the left (as shown) to open the booster valve 8, thus allowing a working gas under pressure to be supplied from the compressor 3 or the tank 9 into the working spaces 1. For reducing the engine output, the accelerator lever 11 is pushed rightward to open the pressure reducing valve 5 for bleeding off some pressure into the compressor 3 to thereby reduce the pressure in the working spaces 1.

The prior output control system of the foregoing arrangement is disadvantageous for the following reasons. When the accelerator lever 11 is inadvertently pushed to the left while the engine is at rest, the booster valve 8 is opened and the working gas flows from the high-pressure tank 9 into the lowest-cycle-pressure line 7, thereby increasing the gas pressure in the working spaces 1. The gas pressure in the working spaces 1 is raised to a level higher than necessary to start the Stirling engine, with the result that difficulty will be experienced in getting the engine started, thus making it necessary to regulate the gas pressure in advance to avoid such difficulty. The Stirling engine or external combustion engine is shut down by stopping the supply of fuel to a combustion chamber, but it takes a long period of time for the engine to stop even after the fuel supply is cut off, the reason being that the gas pressure in the working spaces 1 is kept at an idling pressure. Another problem is that because a gas pressure setting required for starting the Stirling engine is higher than the idling pressure, it is required when starting the engine to raise the gas pressure from the idling pressure up to the pressure setting necessary for setting the engine into motion.

SUMMARY OF THE INVENTION

It is an object of the present invention to provide an output control system for Stirling engines which eliminates the foregoing prior drawbacks by keeping the gas pressure in working spaces at an engine starting pressure setting at all times while engine is held at rest.

According to the present invention, an output control system for a Stirling engine includes a two-way unidirectional solenoid-operated valve disposed in a highest-cycle-pressure line upstream of a pressure reducing valve and a three-way bidirectional solenoid-operated valve disposed in a lowest-cycle-pressure line downstream of a booster valve. The solenoid-operated valves are controlled by a control unit to close the highest-cycle-pressure line and connect the lowest-cycle-pressure line through a regulator valve to a source of high pressure gas when the engine is at rest.

The inventive aspect can easily be incorporated in existing output control systems. The output control system of the invention can be operated with ease.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
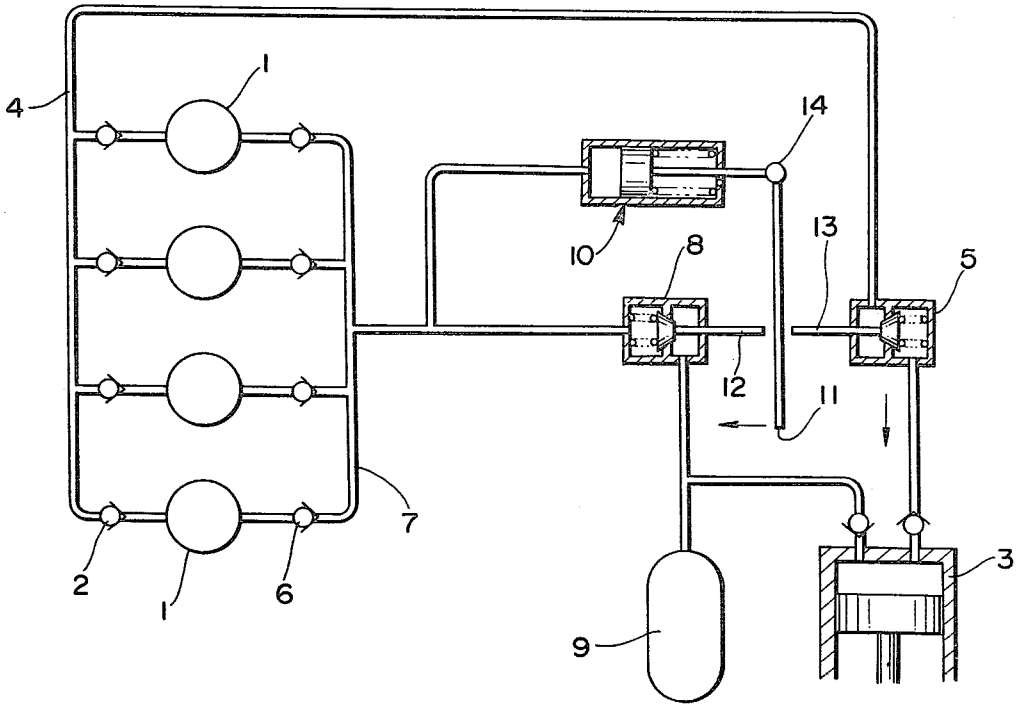
FIG. 1 PRIOR ART
FIG. 1 is a schematic diagram of a conventional output control system for a Stirling engine.
Figure 2:
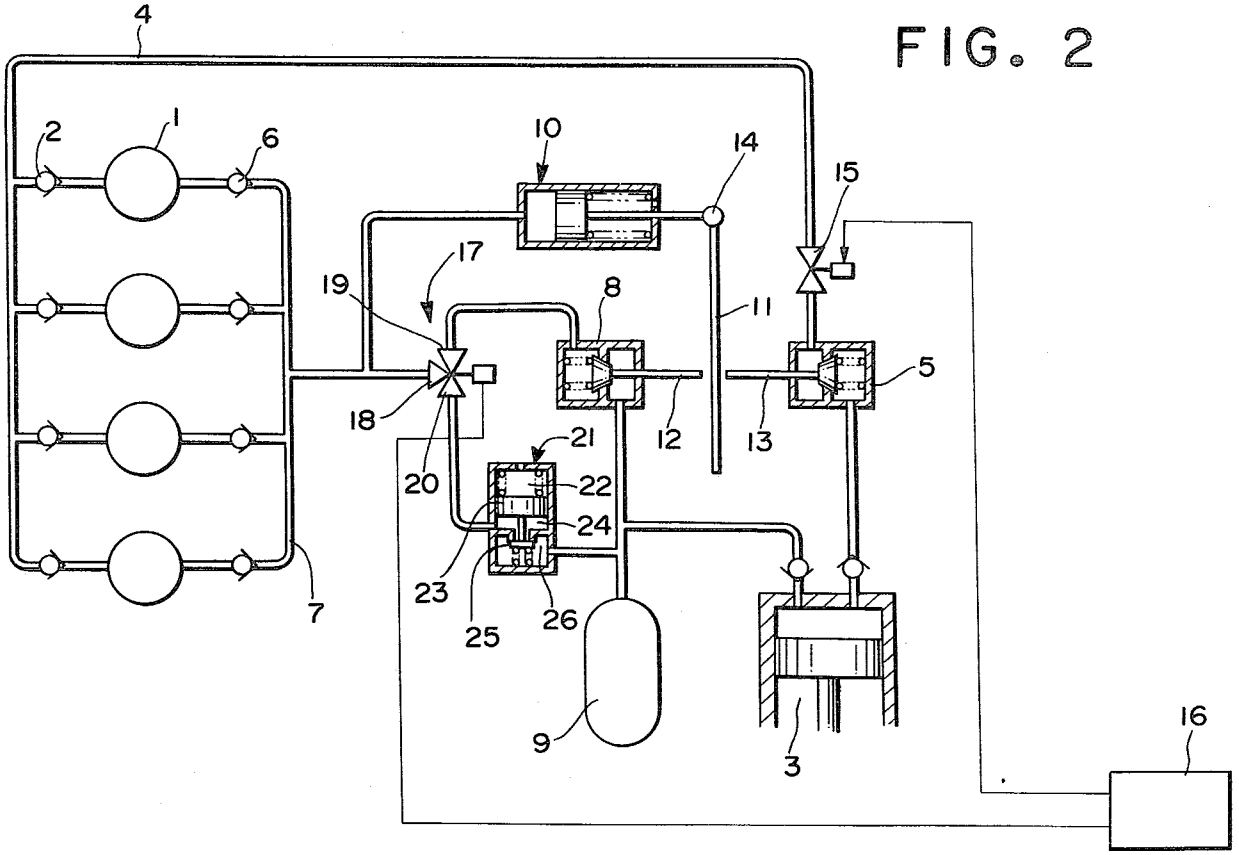
FIG. 2 is a schematic diagram of an output control system for a Stirling engine according to the present invention.

An output control system for a Stirling engine according to the present invention will be described with reference to FIG. 2. Like or corresponding parts shown in FIG. 2 are denoted by like or corresponding reference numerals in FIG. 1, and will not be described in detail.

The highest-cycle-pressure line 4 has therein a two-way unidirectional solenoid-operated valve 15 connected to an upstream port of the pressure reducing valve 5 for controlling the line pressure as it acts in one chamber of the pressure reducing valve 5. The two-way unidirectional solenoid-operated valve 15 can be opened and closed under the control of a control unit 16 which issues a control signal dependent on the speed of rotation of the engine, the state in which the engine is stopped, and other parameters.

The lowest-cycle-pressure line 7 has therein a three-way bidirectional solenoid-operated valve 17 connected to a downstream port of the booster valve 8. The three-way bidirectional solenoid-operated valve 17 has first and second ports 18, 19 providing a circuit connected to the booster valve 8, and a third port 20 coupled through a regulator valve 21 to the high-pressure tank 9 and the compressor 3. The regulator valve 21 has an atmospheric-pressure chamber 22, a line-pressure chamber 24 defined by a piston 23 and held in fluid communication with the third port 20, and a high-pressure chamber 26 defined by a valve body 25. The regulator valve 21 operates such that when the pressure in the line-pressure chamber 24 drops below a working gas pressure setting required for starting the engine, the piston 23 is lowered to open the valve body 25 to thereby keep the line-pressure chamber 24 at the working gas pressure setting for engine starting.

The two-port unidirectional solenoid-operated valve 15 is controlled by the control unit 16 so that the valve 15 is opened when the speed of rotation of the engine reaches an idling speed, and is closed when the engine is completely shut down.

The three-way bidirectional solenoid-operated valve 17 is controlled by the control unit 16 so that when the rotational speed of the engine reaches the idling speed, the first and second ports 18, 19 are brought into mutual communication, and when an engine stop signal is applied, the first and third ports 18, 20 communicate with each other.

Figure 3:
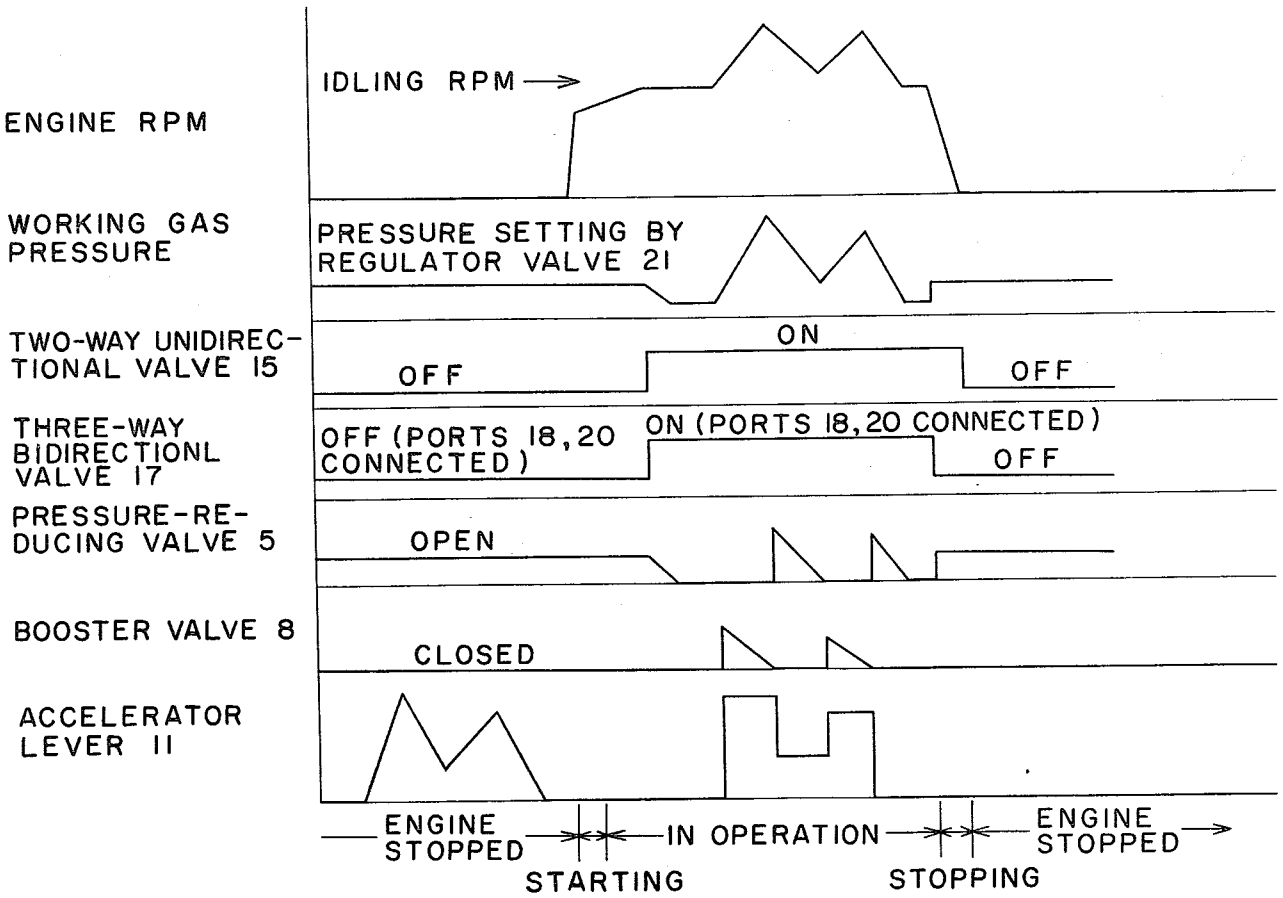
FIG. 3 is a timing chart illustrative of operation of the output control system of the present invention.

Operation of the output control system of FIG. 2 will be described with reference to FIG. 3.

While the Stirling engine is at rest, the solenoid-operated valves 15, 17 are in the de-energized state. The two-way unidirectional solenoid-operated valve 15 is closed, and the three-way bidirectional solenoid-operated valve 17 has the first and third ports 18, 20 connected with each other and the first and second ports 18, 19 out of mutual communication. When the pressure in the lowest-cycle-pressure line 7 drops below the working gas pressure setting for starting the engine, the regulator valve 21 is opened to supply the line 7 with the pressure from the tank 9. Therefore, the working spaces 1 are maintained at the engine starting gas pressure setting at all times. Since the two-way unidirectional solenoid-operated valve 15 is closed, and the first and second ports 18, 19 of the three-way bidirectional solenoid-operated valve 17 are disconnected, the pressures in the lines 4, 7 remain unchanged even when the accelerator lever 11 happens to be moved inadvertently in the direction to open the booster valve 8 while the engine is stopped. As a consequence, any accidental actuation of the accelerator lever 11 exerts no adverse influence on the pressure in the working spaces 1, which are not be converted to working gas pressures that make it difficult to start the engine.

Assume now that the engine is started and the rotational speed thereof reaches the idling speed. The three-way bidirectional solenoid-operated valve 17 is actuated by the control unit 16 to bring the first and second ports 18, 19 into mutual communication and the first and third ports 18, 20 out of mutual communication. When the booster valve 8 is opened by the accelerator lever 11 under this condition, the working gas can be supplied from the high-pressure tank 9 into the working spaces 1. With the engine running at the idling speed, the two-way unidirectional solenoid-operated valve 15 is kept open. Now that the lowest-cycle-pressure line 7 is maintained at the engine starting gas pressure setting, the piston of the feedback piston cylinder 10 is moved to the right (as shown) to cause the accelerator lever 11 to open the pressure reducing valve 5. The working gas from the working spaces 1 returns to the compressor 3 through the two-way unidirectional solenoid-operated valve 15 and the pressure reducing valve 5, so that the gas pressure within the working spaces 1 is reduced down to a pressure necessary for idling. When the working spaces 1 attain the idling pressure, the feedback piston cylinder 10 moves the accelerator lever 11 back to a neutral position to thereby close the pressure reducing valve 5. When the pressure in the working spaces 1 drops below the idling pressure, the two-way unidirectional solenoid-operated valve 15 is not actuated for positive prevention of the pressure reduction in the working spaces 1.

The output of the Stirling engine during normal operation thereof is increased or reduced by actuating the accelerator lever 11 to open or close the valves 5, 8 in the ordinary manner.

When it is desired to stop the engine, the control unit 16 is responsive to an engine stop signal for actuating the three-way bidirectional solenoid-operated valve 17 to cause the first and second ports 18, 19 to be disconnected from each other and the first and third ports 18, 20 to communicate with each other. As a result, the compressor 3 is opened to the working spaces 1 through regulator valve 21 and the pressure reducing valve 5. The engine power is now consumed as compressive work by compressor 3, and the engine is rapidly stopped. When the engine is completely stopped, the control unit 16 deactivates the two-way unidirectional solenoid-operated valve 15 to thereby close the same.

Although a certain preferred embodiment has been shown and described, it should be understood that many changes and modifications may be made therein without departing from the scope of the appended claims.

What is claimed is:

1. A system for controlling the output from a Stirling engine, comprising;

(a) at least one engine working space;

(b) a compressor;

(c) a highest-cycle-pressure line connecting said working space through a first check valve to said compressor and having a pressure reducing valve, said first check valve allowing a working gas to flow from said working space to said compressor;

(d) a lowest-cycle-pressure line connecting said working space through a second check valve to said compressor and having a booster valve, said first check valve allowing the working gas to flow from said compressor to said working space;

(e) a high-pressure tank connected to said booster valve and said compressor;

(f) a feedback piston cylinder connected to said lowest-cycle-pressure line and having a piston rod;

(g) an accelerator lever having an end supported on said piston rod for selectively actuating said pressure reducing valve and said booster valve;

(h) a two-way unidirectional solenoid-operated valve disposed in said highest-cycle-pressure line upstream of said pressure reducing valve;

(i) a three-way bidirectional solenoid-operated valve disposed in said lowest-cycle-pressure line downstream of said booster valve;

(j) a regulator valve connected between said three-way bidirectional solenoid-operated valve and a downstream port of said booster valve and said high-pressure tank; and (k) a control unit for controlling said solenoid-operated valves to close said highest-cycle-pressure line and connect said high-pressure tank through said regulator valve to said working space while the engine is being stopped.

2. An output control system according to claim 1, wherein said three-way bidirectional solenoid-operated valve has first and second ports leading to said working space and said booster valve, respectively, and a third port leading to said regulator valve.

3. An output control system according to claim 2, wherein said regulator valve comprises an atmospheric-pressure chamber, a line-pressure chamber connected to said third port, a piston disposed between said atmospheric-pressure chamber and said line-pressure chamber, a valve body connected to said piston, and a high-pressure chamber communicating with said high-pressure tank and connectable to said line-pressure chamber through said valve body.

* * * * *